United States Patent [19]

Bennett et al.

[11] Patent Number: 4,700,771

[45] Date of Patent: Oct. 20, 1987

[54] MULTI-ZONE BOILING PROCESS AND APPARATUS

[75] Inventors: Douglas L. Bennett, Allentown; Keith A. Ludwig, Emmaus; Alexander Schwarz, Allentown, all of Pa.

[73] Assignee: Air Products and Chemicals, Inc., Allentown, Pa.

[21] Appl. No.: 2,909

[22] Filed: Jan. 13, 1987

[51] Int. Cl.[4] ..... F28F 13/18

[52] U.S. Cl. ..... 165/1; 165/133; 165/146; 165/911

[58] Field of Search ..... 165/1, 133, 146, 911; 62/52; 122/367 C

[56] References Cited

U.S. PATENT DOCUMENTS 3,214,926 11/1965 Shaievitz et al. ..... 62/14
3,457,990 7/1969 Theophilos et al. ..... 165/133
3,630,276 12/1971 Paine et al. ..... 165/133 X

OTHER PUBLICATIONS

"Improved Air Plant Main Condenser" P. S. O'Neill & C. F. Gottzmann.

*Primary Examiner*—A. W. Davis, Jr.
*Assistant Examiner*—Richard R. Cole
*Attorney, Agent, or Firm*—Willard Jones, II; James C. Simmons; E. Eugene Innis

[57] ABSTRACT

The invention relates to a process and apparatus for boiling flowing liquids such as liquefied gases in a heat exchanger in which a circulating flow is occurring, such as in reboiler-condensers in air separation and similar cryogenic plants or other applications where a high efficiency for boiling heat transfer is beneficial. The important feature of the process and apparatus is the use of two sequential heat transfer zones having different pressure drop and heat transfer characteristics in the same boiling channel, the first zone having an overall high-convective-heat-transfer characteristic and an overall higher pressure drop characteristic and comprising a plurality of sub-zones, each sub-zone sequentially having a lower pressure drop than the previous sub-zone and the second zone having a lower pressure drop and an enhanced nucleate boiling heat transfer characteristic.

19 Claims, 14 Drawing Figures

MULTI-ZONE BOILING PROCESS AND APPARATUS

This application is related to U.S. Ser. No. 838.483, filed Mar. 11, 1986 and assigned to Art Unit 346 new U.S. Pat. No. 4,653,572.

TECHNICAL FIELD

This invention relates to an improved method and apparatus for boiling flowing liquids such as liquefied gases in a heat exchanger in which a circulating flow is occurring, such as a thermosyphon heat exchanger for air separation or other cryogenic applications or other applications where a high efficiency for boiling heat transfer is beneficial.

BACKGROUND OF THE PRIOR ART

Various processes have been known and utilized in the prior art for reducing the temperature difference across a reboiler-condenser such as providing the maximum possible heat transfer surface area and/or by enhancing the heat transfer coefficient of the boiling and/or condensing fluid. Generally, in the heat transfer equipment used previously, two heat transfer process schemes have been employed. Both of these process arrangements have the condensing vapor entering at the top of the heat exchanger with the condensate flowing downwards under gravity to exit at the bottom.

One arrangement of the boiling process, termed downflow boiling, is to introduce the liquid at the top of the heat exchanger and allow it to boil while draining under gravity. This has the benefit of a small pressure change with height since the adverse effect of liquid head is largely eliminated. Thus, the boiling temperature of the liquid remains approximately constant along with the temperature difference between boiling and condensing fluids; this helps to maximize the efficiency of the reboiler-condenser. This arrangement has been used infrequently because of the difficulty of distributing liquid uniformly and the necessity to provide an external liquid pumping system to achieve sufficient liquid flow to ensure that the boiling liquid flows over the whole of the heat transfer surface. In an air separation plant, this is necessary for safety reasons as well as to maintain a high heat transfer performance of the boiling surface.

The more common heat transfer process places the heat exchanger in a bath of the boiling liquid so that the boiling surface is immersed. Vapor formed at the boiling surface rises due to buoyancy and carries liquid with it. This induces an upward circulating liquid flow through the boiling zone, with fresh liquid being drawn into the bottom of the zone and excess liquid being discharged at the top end and hence being recirculated to the bottom inlet. This process is termed thermosyphon boiling.

Various types of equipment are known for these above boiling processes. The earliest form was the shell and tube reboiler with boiling either inside or outside of the tubes and using either downflow or thermosyphon schemes. In one improvement the area for heat transfer was increased for the thermosyphon process, and thus the temperature difference reduced, by the introduction of the brazed aluminum reboiler.

In a typical heat exchanger of this design, aluminum plates, designated as parting sheets, 0.03 to 0.05 inches thick are connected by a corrugated aluminum sheet which serves to form a series of fins perpendicular to the parting sheets. Typically the fin sheets will have a thickness of 0.008 to 0.012 inches with 15 to 25 fins per inch and a fin height, the distance between parting sheets, of 0.2 to 0.3 inches. A heat exchanger is formed by brazing an assembly of these plates with the edges enclosed by side bars.

This exchanger is immersed in a bath of the liquid to be boiled with the parting sheets and the fins orientated vertically, Alternate passages separated by the parting sheets contain the boiling and condensing fluids. The liquid to be boiled enters the open bottom of the boiling passages and flows upward under thermosyphon action. The resulting heated mixture of liquid and vapor exits via the open top of the boiling passages. The vapor to be condensed is introduced at the top of the condensing passages through a manifold welded to the side of the heat exchanger and having openings into alternate passages. The resulting condensate leaves the lower end of the condensing passages through a similar side manifold. Special distributor fins, inclined at an angle to the vertical, are used at the inlet and outlet of the condensing passages. The upper and lower horizontal ends of the condensing passages are sealed with end bars.

Attempts to increase the effectiveness of both types of heat exchangers operating by the thermosyphon process have also been made by enhancement of the heat transfer coefficient. In the shell-and-tube heat exchanger, nucleate boiling promoters have been used consisting of a porous metal layer approximately 0.010 inch thick which is bonded metallurgically to the inner tube surface. Heat transfer coefficients in nucleate boiling are enhanced 10–15 fold over a corresponding bare surface. A combination of extended microsurface area and large numbers of stable re-entrant nucleation sites are responsible for the improved performance. The external tube surface is also enhanced for condensation by the provision of flutes on the surface.

Enhanced boiling heat transfer surface has also been applied to the brazed aluminum heat exchanger by scribing the primary boiling surface with many fine lines to promote nucleation. At the same time the boiling passage fins were eliminated. This type of reboiler is described in U.S. Pat. No. 3,457,990 of N. P. Theophilos and D. I-J. Wang.

In both of these types of enhanced reboiler-condensers a single type of heat transfer surface is used throughout the vertical height of the boiling circuit and thus the essentially uniform pressure gradient and varying temperature distribution of the single zone thermosyphon process is preserved with its attendant inefficiency.

BRIEF SUMMARY OF THE INVENTION

The present invention is directed to an improved method and apparatus for boiling flowing liquids in a heat exchanger, the improvement comprising heating said flowing liquid in a heat exchanger having two sequential heat transfer zones of different characteristics. The heat exchanger comprising: a first heat transfer zone having an overall high-convective-heat-transfar characteristic and an overall higher pressure drop characteristic and comprising a plurality of sub-zones characterized in that each consecutive sub-zone in the direction of flow comprises a surface with a decreased pressure drop characteristic than the preceding sub-zone; and a second heat transfer zone comprising an essentially open channel with only minor obstruction by secondary surfaces, with an enhanced nucleate boiling heat transfer surface and a lower pressure drop characteristic.

BRIEF DESCRIPTION OF THE DRAWINGS

FIG. 1(*b*) is a schematic diagram of a multi-zone boiling of the present invention.

FIG. 2(*b*) is a fragmentary perspective view of a multi-zone tube boiling channel according to the present invention in a shell and tube heat exchanger with portions removed to show a first zone with two regions of differing fins as secondary surfaces and a second zone with an enhanced nucleate boiling surface.

FIG. 4(*b*) is an illustration of a multi-zone boiling channel in operation.

DETAILED DESCRIPTION OF THE INVENTION

Figures 1A, 1B:
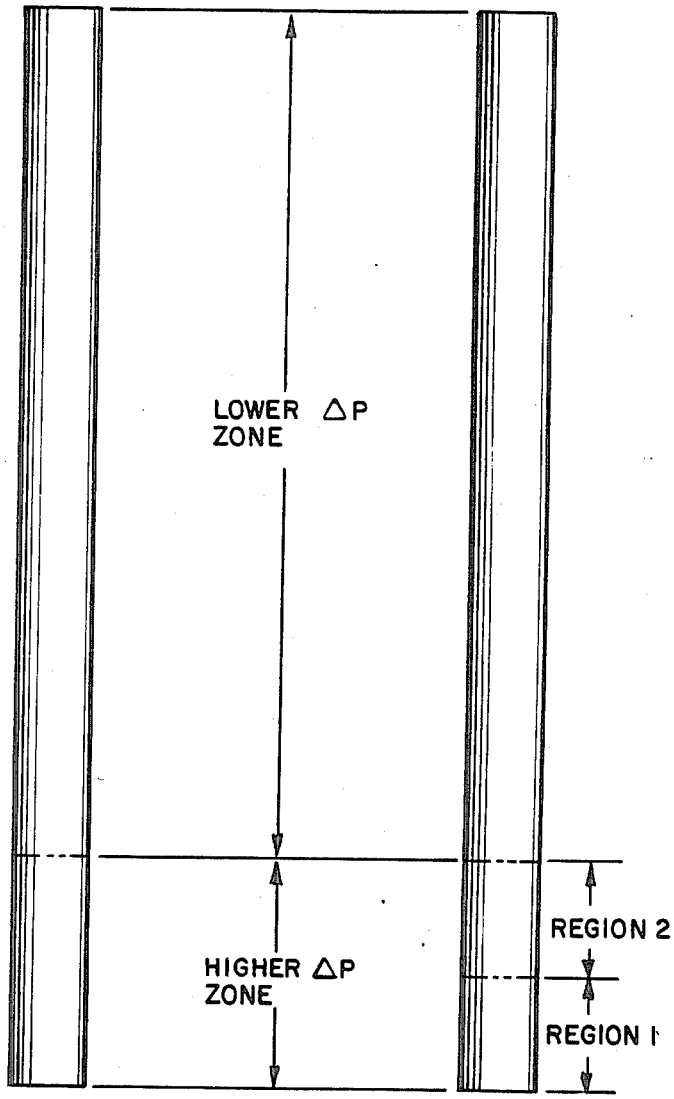
FIG. 1(*a*) is a schematic diagram of a dual zone boiling channel.

To better understand the present invention it is important to understand the development of the multi-zone boiling channel process.

In the operation of a cryogenic air separation plant, such as the generally used double column design, as described in U.S. Pat. No. 3,214,926, the power consumption of the air compressor is related to the temperature difference between the oxygen being boiled in the low pressure column and the nitrogen being condensed in the high-pressure column. Reduction of the temperature difference across this reboiler-condenser will permit reduction of the power consumption for the production of oxygen and nitrogen. Typically, a reduction of one degree Fahrenheit in the temperature difference at the top of the reboiler will permit a reduction of about 2.5% in air compression power. It is also important that the reboiler-condenser equipment should be compact and preferably able to fit entirely within the distillation column. This minimizes the cost of equipment, shipping and installation at the plant site. It is also necessary that these improvements should be effected in a completely safe manner, which in the particular instance of an air separation plant requires that boiling should occur without any possibility of total vaporization of liquid, i.e. dry out.

Therefore, it is the purpose of the dual zone boiling process to reduce both power cost and capital cost associated with the air separation process. Similar benefits should be obtained in other processes where a reduction of heat transfer temperature difference in a compact device is required, especially in the cryogenic process industry; for example, in the processing of natural gas, hydrogen, helium and other gases where the cleanliness of the system permits the use of compact heat exchange equipment.

It is important to examine the solution to the above problem, i.e. thermosyphon boiling. The disadvantage of this process is that the pressure gradient throughout the boiling passage is relatively constant. Thus, the boiling temperature of the liquid changes considerably throughout the height of the boiling channel thereby causing a substantial variation in temperature difference between the condensing vapor on the one side of the exchanger and the boiling liquid on the other thus reducing the efficiency of the heat exchanger. In addition, the liquid enters the bottom of the boiling zone at below its boiling temperature due to the increase in pressure by liquid head and must be increased in temperature, by less effective convective heat transfer, until it reaches its boiling temperature at a higher location in the boiling channel. The effect of the dual zone boiling process is to produce a variation in boiling pressure, temperature and temperature difference with respect to height in the boiling channel.

Three regions of heat transfer may be identified in the boiling channel. The first region is convective heat transfer which extends from the inlet of the boiling channel to the point where the bulk temperature of the fluid equals the saturation temperature of the liquid at the local pressure. The second region, the liquid superheated region, is where the bulk temperature of the liquid exceeds the saturation temperature without boiling; this region occurs in the zone between the point where the bu1k temperature of the fluid equals the saturation temperature of the liquid at the local pressure until the point where full nucleation and vapor generation occurs. The third region exhibits nucleate and/or convective boiling with upwardly decreasing pressure and temperature.

The purpose of the dual zone boiling process is to overcome the effect of this circulating flow boiling process to produce a variation in boiling pressure, temperature and temperature difference with respect to height in the boiling channel. The important feature of the dual zone boiling process is the use of two sequential heat transfer zones having different pressure drop and heat transfer characteristics in the same boiling channel as illustrated in FIG. 1(*a*). This combination is synergistic in providing a greater heat transfer efficiency than can be achieved by either individual zone.

The first heat transfer zone comprises a higher pressure drop, high-convective-heat-transfer zone with extended secondary fin surfaces. These secondary fin surfaces are installed in the lower nonboiling region of the boiling channel. The length of the finned section will depend upon the thermophysical properties of the liquid, local heat and mass fluxes and heat transfer coefficients. Basically, the length of the finned section should be long enough to completely preheat the liquid to saturation temperature, so the more effective nucleate boiling can occur in the second zone. For a cryogenic reboiler-condenser, this length will be in the range of about 10% to about 60% of the total length of reboiler-condenser, with the optimum being between about 20% and about 40% of its total length.

The second heat transfer zone comprises an essentially open channel with only minor obstruction by secondary surfaces and with enhanced nucleate boiling heat transfer surface and a low pressure drop characteristic. This is typically located in the upper boiling region of the boiling circuit. The enhanced surfaces can be of any type, the invention does not preclude any of the methods of forming an enhanced boiling surface. Nevertheless, it is beneficial to utilize high-performance enhanced surfaces such as a bonded high-porosity porous metal, micro-machined, or mechanically formed surface having heat transfer coefficients three (3) or more times greater than for a corresponding flat plate.

Figure 2A:
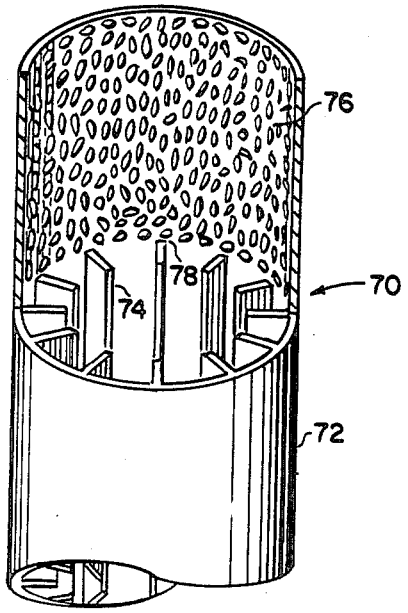
FIG. 2(*a*) is a fragmentary perspective view of a dual zone tube boiling channel in a shell and tube heat exchanger showing a first zone with internal fins as the secondary surface and a second zone with an enhanced nucleate boiling surface.
Figure 2B:
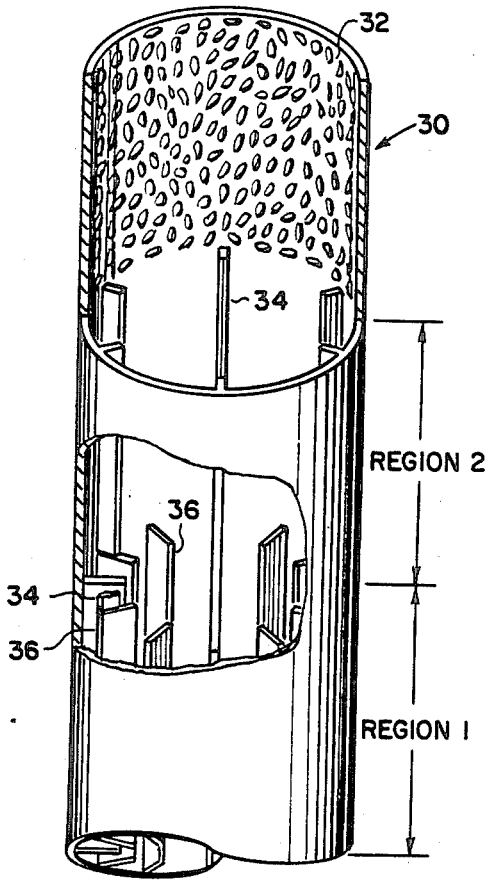

This dual zone method of flowing liquid boiling, e.g., thermosyphon, may be incorporated into heat exchangers of both the vertical shell-and-tube type and the plate-fin brazed aluminum type. One configuration of the dual zone method is a tube boiling channel having dual zone boiling surfaces for a shell-and-tube type of reboiler as shown in FIG. 2(*a*). As for the dual zone boiling surfaces of the tube, the lower portion is internally finned whereas the upper portion has none or few fins, but has an enhanced nucleate boiling surface. In a shell-and-tube reboiler of this type, the heat exchanger would be a bundle of these tubes in a shell casing. In this configuration, boiling flow occurs inside tube 70 with the heat duty for the boiling supplied by a condensing or other heat exchange medium on the shell side (outside surface 72) of the exchanger. The fluid to be boiled enters the bottom of tube 70 as oriented on the drawing and flows upwardly through the tube, first through the internally finned section 74 and then through the enhanced nucleate boiling surface section 76, and exits at the top of the tube 70. The boiling fluid enters the boiling passage as a liquid, initiates boiling about at the interface of the two sections 78 and exits from the boiling passage as a gas liquid mixture.

Although the dual zone boiling process and apparatus solved a major problem of channel boiling, some problems remained with the dual zone process. Since the dual zone enhanced surface reboiler contains an initial high pressure drop, high convective heat transfer zone followed by a lower pressure drop, high nucleate boiling zone, the lower pressure drop zone has poor convective heat transfer characteristics, the liquid temperature entering this zone must be at or very nearly equal to its bubble point to avoid inadequate utilization of a portion of the lower pressure drop region and a reduction in performance. Additionally, if boiling occurs within the high pressure drop region, a significant increase in the pressure drop will occur. Since the recirculation rate in a thermosyphon reboiler is dependent upon the overall pressure drop within the reboiler, a significant reduction in the recirculation rate can occur. This reduced recirculation results in a reduction in reboiler performance.

For a single reboiler duty, it is theoretically possible to design the dual zone enhanced surface reboiler so that the liquid temperature is equal to its bubble point when it moves from the high pressure drop zone to the lower pressure drop zone. However, reboilers must be designed for multiple duties. Under different operating rates, boiling will occur at different locations within the reboiler, resulting in less than optimal performance for dual zone design at off-design rates.

A solution to this problem is to subdivide the higher pressure drop zone into two or more regions. FIG. 1(*b*) illustrates the concept by dividing the higher pressure drop zone into two regions or sub-zones. The higher pressure drop zone of this design consists of a high pressure drop region, shown as Region 1, and a lower pressure drop region, shown as Region 2. Although the pressure drop characteristics of Region 2 are lower than that for Region 1, the overall pressure drop characteristic and the overall convective heat transfer characteristic for the higher pressure drop zone are significantly higher than those in the lower pressure drop zone.

In the normal range of operation for a reboiler designed according to the present invention, the temperature of the fluid within Region 1 will usually be either below its bubble point (bubble point being the point on a phase diagram which represents an equilibrium between a relatively large amount of liquid and the last increment of vapor) or at a temperature below that required to initiate boiling at the high heat flux conditions occurring in Region 1. When this fluid reaches Region 2, boiling will typically begin to occur, and when boiling occurs in Region 2, a modest increase in pressure drop will occur, however, this modest increase only causes a minor decrease in circulation rate. Therefore, no appreciable decrease in reboiler performance will occur.

It is particularly desirable to initiate boiling within Region 2 and as close to possible to the interface between Region 1 and 2. Region 1 is a higher heat flux region than Region 2, which results from a higher thermal driving force in Region 1 and the higher heat transfer coefficients typical of Region 1. Liquid superheat is the difference between the wall temperature and the local liquid bubble point temperature. It is known in the art that the liquid superheat needed to initiate boiling is proportional to the heat flux. In general, the fluid leaving Region 1 is superheated, however, because of the large heat flux within Region 1, nucleation is suppressed. This suppression is an advantage because this superheated fluid within Region 1 will usually enter Region 2, which has a lower heat flux, at a level of superheat above the minimum value required for boiling initiation at the lower heat flux. Thus the drop in heat flux from Region 1 to Region 2 along with the superheat in the fluid leaving Region 1 will usually result in boiling initiation in Region 2 and therefore boiling throughout the lower pressure drop zone.

To accomplish this change in heat flux and therefore the initiation of boiling, the heat transfer and pressure drop characteristics of the two regions must differ. For a given liquid circulation rate, the pressure drop within a region where bubbling has not occurred, is proportional to $fL/D_H$ (where L is the length of the region, $D_H$ is the hydraulic diameter of the flow passage and f is either the Fanning or Moody friction factor. Thus, for a two region higher pressure drop zone, it is desirable to have $$(fL/D_{H1}) > (fL/D_{H}2)$$

where the subscript 1 refers to the first sequential region and the subscript 2 refers to the second sequential region within the higher pressure drop zone.

Thus a ratio, $\beta$, between the characteristics of the two regions can be defined to aid in design of the boiling channel higher pressure drop zone. $\beta$ is defined as $$\frac{\left(\frac{fL}{D_{H1}}\right)}{\left(\frac{fL}{D_{H2}}\right)} \equiv \beta$$

Thus, if $\beta$ equals 1, the design is essentially identical to the dual zone design. If $\beta$ is less than 2, performance of the multi-zone boiler will be very similar to the dual zone design and the additional complexity of the multi-zone reboiler is probably unjustified. Significant advantages are expected for values of $\beta > 5$, with optimal designs occurring at values of $\beta > 10$.

Figure 3:
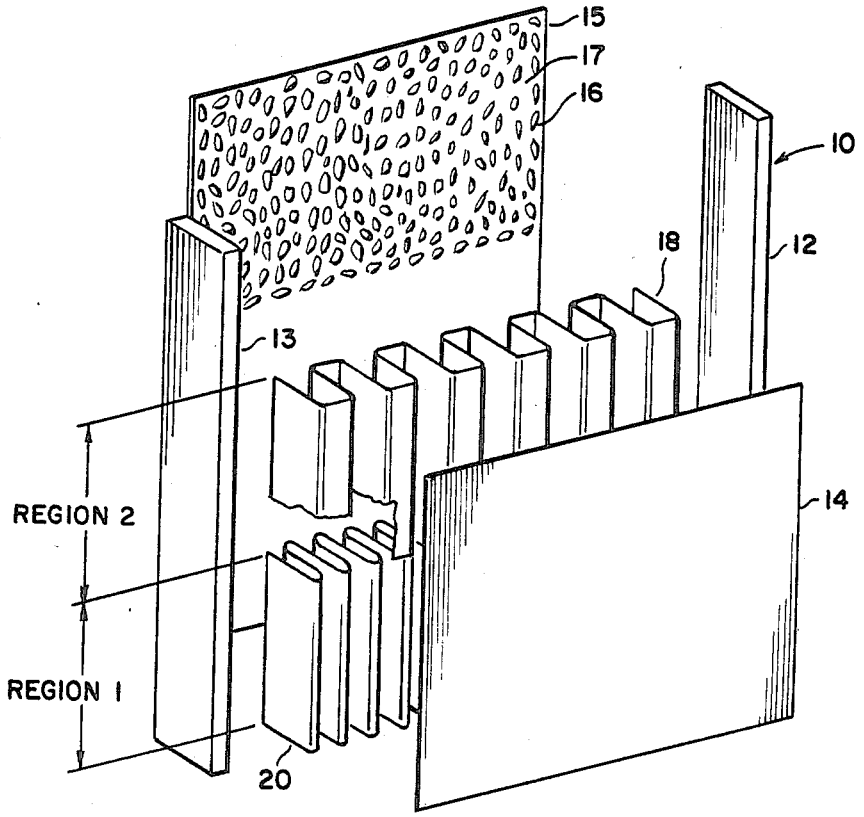
FIG. 3 is an exploded perspective view of a boiling channel according to the present invention in a compact plate-fin brazed heat exchanger showing a first zone with two regions of differing internal fins as the secondary surfaces and a second zone with an enhanced nucleate boiling surface.

The principles of the above invention can be incorporated into any heat exchanger configuration. For example, FIG. 2(*b*) illustrates the concept applied to a boiling channel of a tube and shell configuration and FIG. 3 illustrates the concept as applied to the boiling channel of a plate/fin exchanger.

With reference to FIG. 2(*b*), a boiling channel for a shell and tube heat exchanger is shown. In boiling channel 30, the upper surface portion of the channel, i.e. the lower pressure drop zone, is coated with enhanced boiling surface 32. The lower portion of the channel, i.e. the higher pressure drop zone, contains fins 34 and 36. Fins 36 are contained in Region 1 and Fins 34 are contained in Region 2. As can be seen from FIG. 2(*a*) the depth and the number of fins 34 in Region 2 are less than the depth and the number of fins 36 in Region 1. preferred designs using tube configurations can also require different fin types for Regions 1 and 2. Region 2 can have simple extended surfaces running parallel to the flow direction. Region 1 can have a variety of designs for example , a spiral fin, a series of radial fins which could be perforated, a series of perforated disks mounted normal to the flow or a series of baffles within the tube. Another approach is that Region 1 can be constructed of one or more tubes with a diameter significantly smaller than the diameter of the tube or tubes comprising the lower pressure drop region within the higher pressure drop zone; these tubes need not be circular.

As mentioned in the prior paragraph, Region 1 or Subzone 1 can have a variety of designs, examples of such are shown in FIGS. 6 through 9. Common elements between FIGS. 6 through 9 and FIG. 2*b* have been assigned the common numbers.

Figure 6:
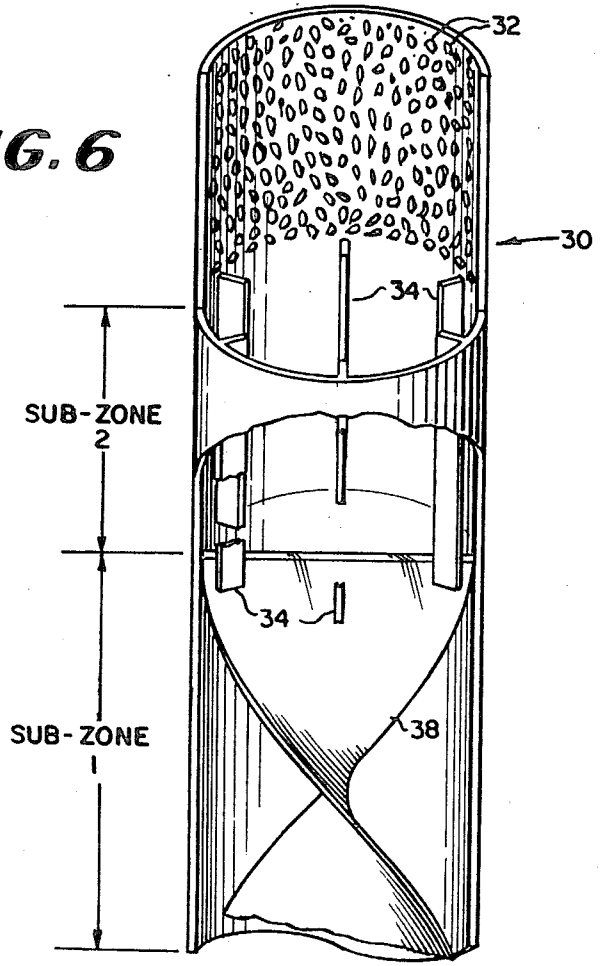

With reference to FIG. 6, a boiling channel for a shell and tube heat exchanger is shown. In boiling channel 30, the upper surface portion of channel 30, i.e. the lower pressure drop zone, is coated with enhanced being surface 32. The lower portion of channel 32, i.e.. the higher pressure drop zone contains straight fins 34 in Subzone 2 and spiral fin 38 in Subzone 2.

Figure 7:
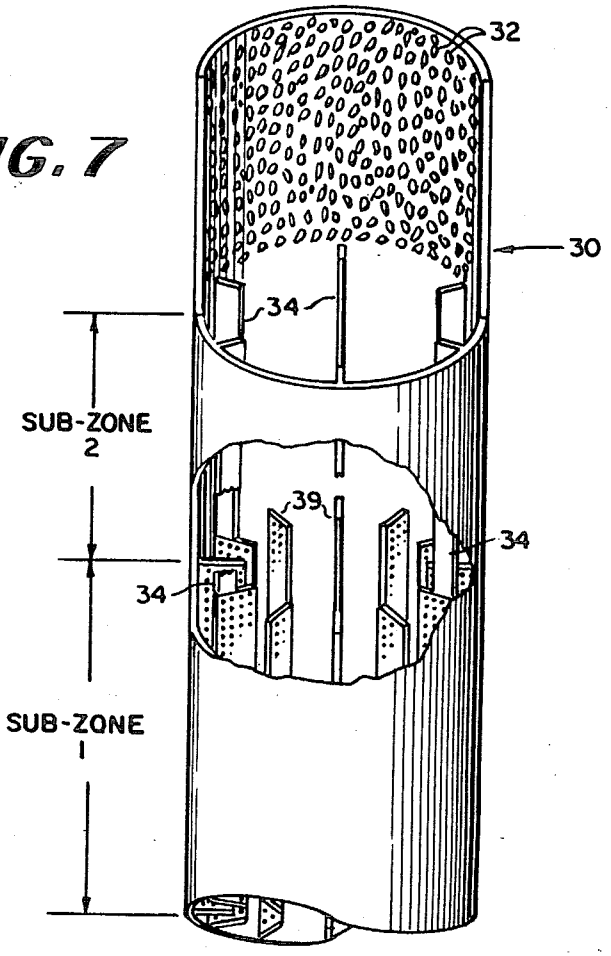
FIGS. 6 through 11 are schematic diagrams of multi-zone boiling channels illustrating the various types of fins that can be used.

With reference to FIG. 7, a boiling channel for a shell and tube heat exchanger is shown. In boiling channel 30, the upper surface portion of channel 30, i.e. the lower pressure drop zone, is coated with enhanced boiling surface 32. The lower portion of channel 32, i.e. the higher pressure drop zone contains straight fins 34 in Subzone 2 and perforated radial straight fine fins 39 in Subzone 2.

Figure 8:
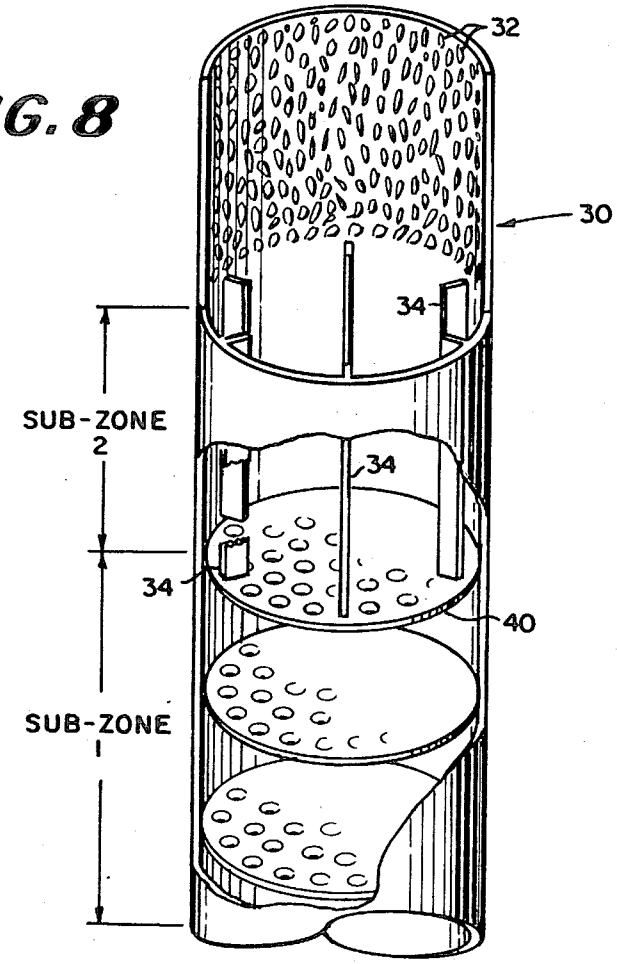

With reference to FIG. 8, a boiling channel for a shell and tube heat exchanger is shown. In boiling channel 30, the upper surface portion of channel 30 i.e. the lower pressure drop zone, is coaoted with enhanced boing surface 32. The lowe portion of channel 32, i.e. the higher pressure drop zone contains straight fins 34 in Subzone 2 and a series of perforated disks 40 mounted normal to the flow in Subzone 2.

Figure 9:
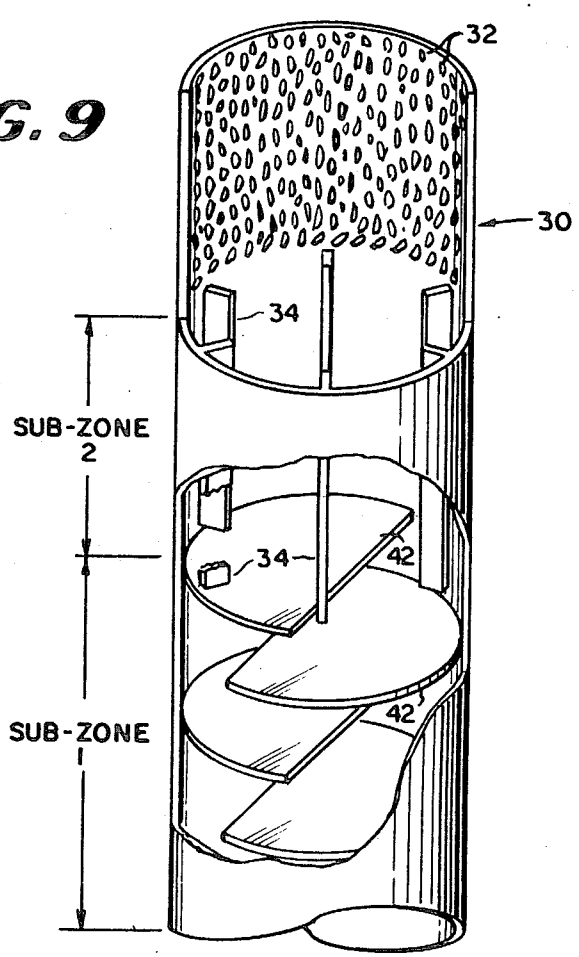

With reference to FIG. 9, a boiling channel for a shell and tube heat exchanger is shown. In boiling channel 30, the upper surface portion of ch annel 30, i.e. the lower pressure drop zone, is coated with enhanced boing surface 32. The lower portion of channel 32, i.e. the higher pressure drop zone contains straight fins 34 in Subzone 2 and a series of bffles 42 within channel 30 in Subzone 2.

With reference to FIG. 3, an exploded perspective of boiling channel 10 of a plate/fin heat exchanger is shown. Boiling channel 10 is enclosed by side bars 12 and 13 and plates 14 and 15; note plate 14 has been shortened to provide better detail of boiling channel 10. The upper surfaces, i.e. the lower pressure drop zone of channel 10, of plates 14 and 15 are coated with an enhanced boiling surface 16 such as shown as 17 on plate 15. This enhanced boiling surface 16 is such that the zone of the channel coated with the surface is an essentially open channel. The lower portion of the channel, i.e. the higher pressure drop zone, contains fins 18 and 20. As can be seen from FIG. 3, Region 1 of the higher pressure drop zone is shown containing corrugated fin surface 20 which has twice as many fins per unit length as corrugated fin surface 18 in Region 2. Although corrugated fin surface 20 is shown as abutting corrugated fin surface 18, it is possible and probably sagacious for a small space to be present between the two finned surfaces.

For plate/fin reboilers, many types of fins are possible. Some fin types are listed below:

straight fin (SF)
"easyway" perforated fin (EPF)
"hardway" perforated fin (HPF)
"easyway" serrated fin (ESF)
"hardway" serrated fin (HSF)

"Easyway" and "hardway" refer to the orientation of the fin with respect to the flow direction. "Easyway" implies that the length of the fin is in the direction of flow. "Hardway" implies that the length of the fin is perpendicular to the flow direction. Flow in a "hardway" direction through the fins required the fluid to flow through either the perforations for a perforated "hardway" fin or through the slots or gaps which occur in serrated "hardway" fins.

Typical candidates for Region 1 fins are ESF, HPF and HSF. Typical candidates for Region 2 fins are SF, EPF and ESF. The following table shows the typical range of $\beta$'s possible with these combinations of fin types.

| Configuration | Region 1 | Region 2 | $\beta$ |
|---|---|---|---|
| A | SF/EPF | SF/EPF | $1 < \beta < 3$ |
| B | EPF/ESF | SF/EPF | $3 < \beta < 10$ |
| C | HPF/HSF | SF/EPF | $\beta > 15$ |
| D | HPF/HSF | ESP | $5 < \beta < 15$ |

Figure 10:
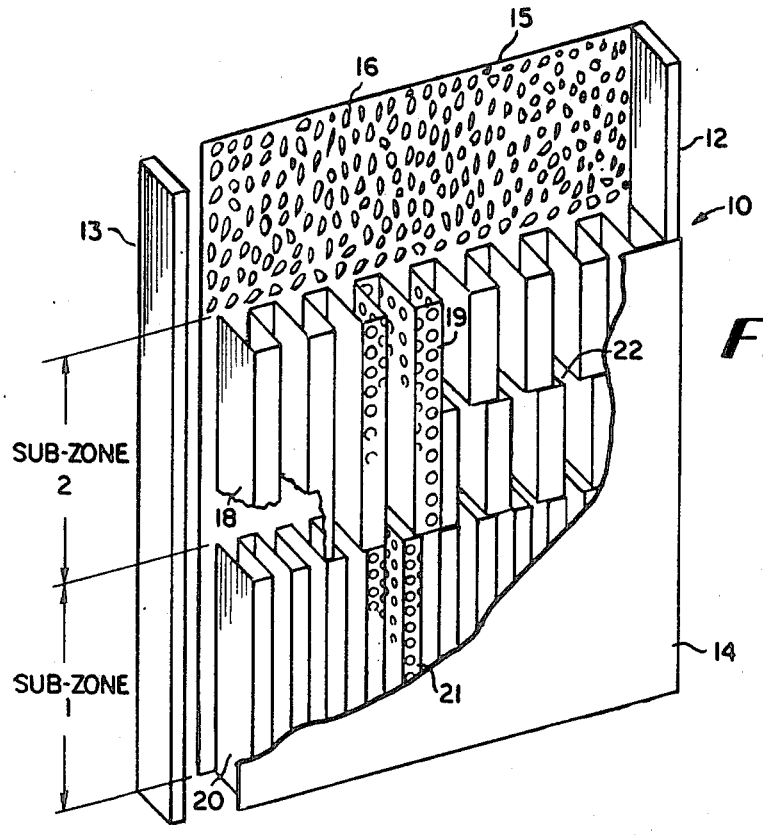
Figure 11:
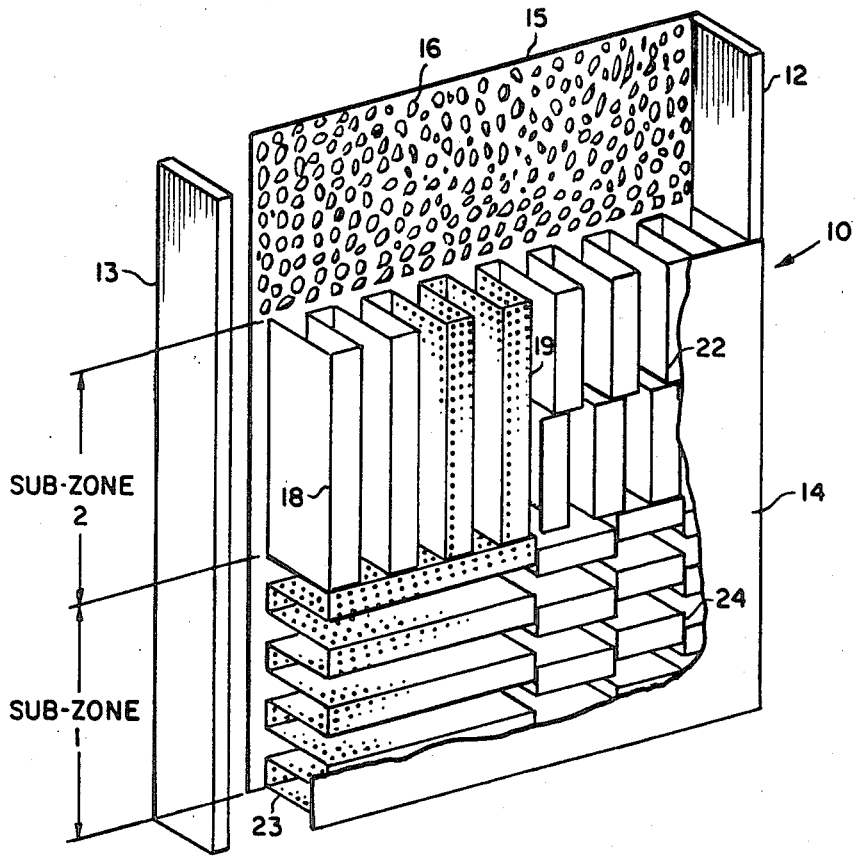

As mentioned in the preceding paragraphs, Region 1 or Subzone 1 and Region 2 or Subzone 2 can have a variety of designs, examples of such are shown in FIGS. 10 and 11. Common elements between FIGS. 10 and 11 and FIG. 3 have been assigned the common numbers.

With reference to FIG. 10, an exploded perspective boiling channel 10 of a plate fine heat exchanger is shown. Boiling channel 10 is enclosed by side bars 12 and 13 and plates 14 and 15; note sections of plate 15 have been removed to provide better detail of boiling channel 10. The upper surface of channel 10, of plates 14 and 15 are coated with an enhanced boiling surface 17 as illustrated on plate 15. The lower portion of channel 10 contains fins 18, 19, 20, 21 and 22. Straight fins 18, perforated fins 19 and serrated fins 22, all in an "easyway" mode, are shown as alternatives to each other for use in Subzone 2. Straight fins 20 and perforated fins 21, both in an "easyway" mode, are shown as alternatives to each other for use in Sub zone 1.

With reference to FIG. 11, an exploded perspective of boiling channel 10 of a plate fine heat exchanger is shown. Boiling channel 10 is enclosed by side bars 12 and 13 and plates 14 and 15; note sections of plate 15 have been removed to provide better detail of boiling channel 10. The upper surface of channel 10, of plates 14 and 15 are coated with an enhanced boiling surface 17 as illustrated on plate 15. The lower portion of channel 10 contains fins 18, 19, 22, 23 and 24, Straight fins 18, perforated fins 19 and serrated fins 22, all in an "easyway" mode, are shown as alternatives to each other for use in Subzone 2. Perforated fins 23 and serrated fins 24, both in an "hardway" mode, are shown as alternatives to each other for use in Subzone 1.

In the above table the preferred embodiment are configurations C and D.

Another aspect of the present invention is that the surface of the last sequential sub-zone or region in the higher pressure drop zone can be coated with an enhanced nucleate boiling surface.

Figures 4A, 4B:
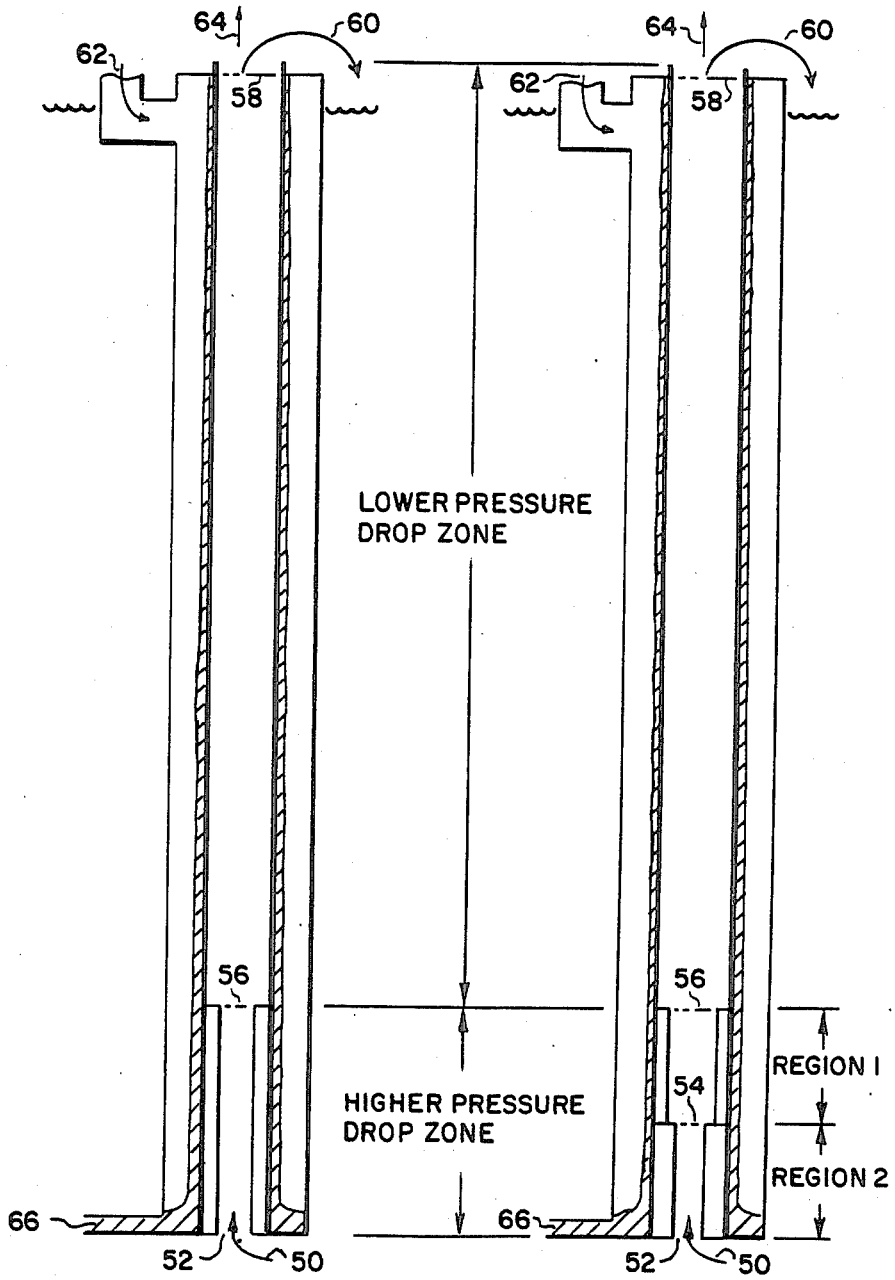
FIG. 4(*a*) is an illustration of a dual zone boiling channel in operation.

The advantages of the multi-zone reboiler over the dual zone reboiler can be exemplified by the following example. FIGS. 4(*a*) and 4(*b*) illustrate the model. For this illustration, it is assumed that pure component stream 62 is condensed and removed as condensate via passage 66. The pressure gradients on the condensing side are assumed small and the condensing heat transfer coefficients are assumed large. These assumptions result in an approximately uniform wall temperature throughout the length of the reboiler tube. If this constant wall temperature is above the local bubble point of the boiling fluid, boiling can occur. Boiling will result in circulation of fluid through the reboiler, i.e. liquid stream 50 will enter the bottom of the reboiler at location 52 and a mixed phase stream will exit the reboiler at location 58. The mixed phase stream exiting the reboiler at location 58 will separate by gravity into liquid stream 60 and vapor stream 64.

The total pressure drop between the reboiler tube inlet (location 52) and the top of the reboiler tube (location 58) is constant for all operating conditions and is equal to the static head of the liquid in the reservoir. This pressure drop in the reboiler tube is the sum of the frictional pressure drop caused by the circulating fluid, the pressure drop due to flow acceleration and the static head within the reboiler tube. The pressure drop due to flow acceleration is typically small and can usually be neglected. The static head within the reboiler tube is less than the static head in the reservoir. This imbalance causes the liquid circulation. For a given static head imbalance, the liquid circulation rate depends upon the frictional pressure drop in the reboiler tube.

To allow a consistent comparison of a dual zone design against a multi-zone design, the total pressure drop across the higher pressure drop zone will be assumed constant for both cases assuming no boiling occurs within the higher pressure drop zone. In addition, the total heat transfer to the circulating fluid will be assumed equal for both the dual zone and multi-zone designs, assuming no boiling occurs within the higher pressure drop zone. This assumption is reasonable and is based on the Reynolds analogy between momentum and heat transfer. Therefore, for operating conditions resulting in boiling at the interface between the lower and higher pressure drop zone, the dual zone and multi-zone reboiler design would have identical performance characteristics. Furthermore, for operating conditions resulting in the initiation of boiling within the lower pressure drop zone, the dual zone and multi-zone reboiler design should have essentially identical performance characteristics.

The boiling zone within the reboiler tube moves to lower levels within the reboiler tube as the difference between condensation temperature, or tube wall temperature for this case, and the bubble point of the boiling fluid increases. Increasing this thermal driving force also increases vapor boil-up. For both the dual zone and multi-zone reboilers, it is desirable to have the boiling zone extend from the top of the boiling tube to at least location 56. Location 56 corresponds to the end of the higher pressure drop (and higher convective heat transfer) zone. If the boiling region does not extend down to location 56, the remaining single-phase heat transfer duty can only be accomplished by the poor convective heat transfer characteristics of the enhanced boiling surface material.

As the boiling zone moves below location 56, the advantages of the multi-zone design over the dual zone design becomes indicated earlier, for operating conditions resulting in boiling occurring above location 56, the total pressure drop within the higher pressure drop zone is identical for both the dual zone and multi-zone design. However, for conditions resulting in boiling below location 56, preferably at location 54, the dual zone design and multi-zone design behavior differs substantially. To describe these differences, the impact of increasing the pressure drop in the higher pressure drop zone on the performance of the dual zone design needs to be discussed.

By design, most of the frictional pressure drop is in the higher pressure drop zone. Therefore, the pressure drop in the lower pressure drop zone is low and the temperature variation for a pure component fluid is small within the lower pressure drop zone. The relatively constant temperature difference between the wall and boiling fluid throughout the lower pressure drop zone yields the improved performance characteristics of the dual zone enhanced surface reboiler, when compared to the performance of conventional thermosyphon reboilers.

For this example, the condensate temperature will be kept constant (and therefore the wall temperature is constant). However, the performance of the reboiler will be altered by adjusting the pressure drop in the higher pressure drop zone. As this pressure drop increases, the liquid circulation rate decreases. A substantial increase in the pressure drop in the higher pressure drop zone can substantially reduce the circulation rate through the reboiler tube. A substantial reduction in liquid recirculation can decrease the performance of the reboiler by one or more of the following mechanisms:

Provide insufficient wetting of the enhanced boiling surface thus promoting ineffective utilization of regions of the lower pressure drop zone, thereby reducing heat transfer and degrading performance.

provide insufficient wetting of the enhanced boiling surface thus promoting accumulation of heavy components within the reboiler tube or the enhanced surface boiling material. Heavy components being normally soluble components of the boiling fluid which are concentrated due to vaporization. Such accumulation can adversely impact the thermal driving force and/or decrease the local heat transfer coefficient and degrade reboiler performance. In some cases, accumulation of heavy components can also lead to unsafe operating conditions.

Induce a thermally unstable reboiler.

From the above discussion, it should be clear that the most desirable reboiler design should have a recirculation rate which is sufficient to avoid the problems cited above. In addition, it is desirable to have a recirculation rate which is not excessive at low boil-up rates since larger circulation rates require additional surface to bring the incoming liquid to its bubble point.

Figure 5:
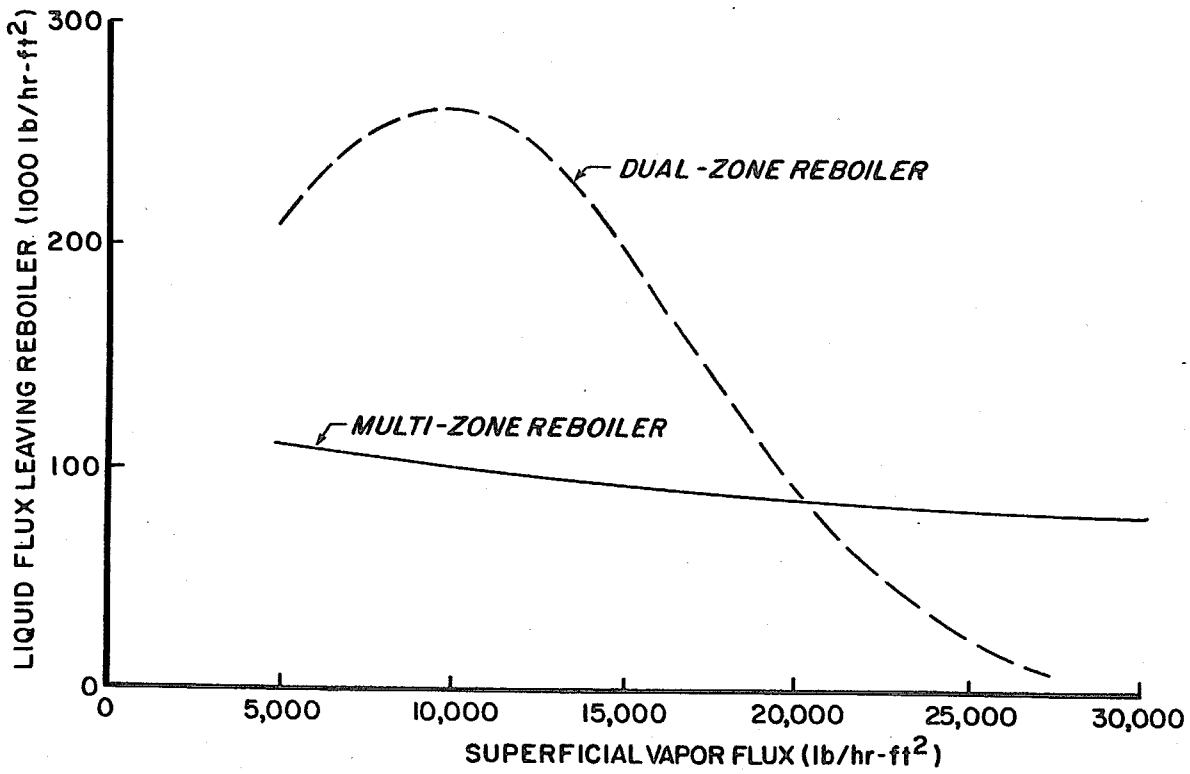
FIG. 5 is a plot of the variation of liquid flux leaving a reboiler with boil-up rate for dual zone and multi-zone reboiler designs.

FIG. 5 illustrates the relationship between the quantity of liquid leaving the top of the reboiler vs. the boil-up rate. These calculations consider the impact of heat transfer on the location of the initiation of boiling. For this example, both the dual zone and multi-zone reboiler are 6.67 ft. high. The hydraulic diameter of the flow passage ($D_H$) of the high pressure zone is assumed equal to 0.15 inches. For conditions with nonboiling within the high pressure zone, both designs have identical total pressure drop. For the multi-zone reboiler, the pressure drop within Region 1 was assumed to equal 32 times that in Region 2. The liquid and vapor density are 70 $lb/ft^3$ and 0.45 $lb/ft^3$, respectively.

FIG. 5 shows that the dual zone reboiler has a very large liquid throughput at low boil-up rates. The decrease in liquid circulation below a boil-up rate of 10,000 $lb/hr\text{-}ft^2$ results from boiling initiation occurring within the lower pressure drop zone. As boil-up increases, liquid rate initially increases due to an expansion of the two-phase zone, which causes an increase in the recirculation driving force. As boil-up continues to increase, the resistance to flow in the higher pressure drop zone decreases the recirculation rate. For this example, the two-phase zone reaches location 56, FIG. 4(*a*), for the dual zone reboiler at a boil-up rate of about 15,000 $lb/hr\text{-}ft^2$. As boil-up increases, the recirculation rate is shown to reduce substantially. This results from the penetration of the two-phase region into the higher pressure drop zone.

FIG. 5 also shows the calculated recirculation rate for the multi-zone reboiler. A remarkably constant recirculation rate is seen for the entire range of boil-up rates. For the entire range of boil-up rates, initiation of the two-phase zone lies within Region 2 (between location 56 and 54 of FIG. 4(*b*)).

An added advantage of this design is that nucleation is suppressed within Region 1. This is because the high local heat flux resulting from the high heat transfer coefficients and high thermal driving force within Region 1, inhibit boiling initiation. Generally, the liquid leaving Region 1 will be superheated and therefore boiling initiation will occur upon entering the lower heat flux region, i.e., Region 2.

The performance of the multi-zone reboiler will be superior to that of the dual zone reboiler because of the following reasons:

The lower recirculation rates at lower boil-up rates will reduce the heat transfer duty needed to bring the recirculating liquid to its bubble point. The lower heat duty will result in a lower temperature approach for a given boil-up rate.

For an extended operating range, initiation will occur within Region 2. Even though boiling initiation occurs in the higher pressure drop zone, it occurs in the lower pressure drop region of the higher pressure drop zone. Therefore, a significant reduction in liquid recirculation does not result.

At high boil-up rates, good recirculation is maintained, thus providing complete wetting of the enhanced surface within the lower pressure drop region, thus substantially reducing any accumulations of heavy components within the boiling stream.

The preceding description discusses the present invention utilizing two regions or sub-zones in the higher pressure drop zone, however, there are times when more than two regions would be desirable. For a given range of operation and for a given exchanger geometry, the circulation rate will largely depend upon the pressure drop in the higher pressure zone. The total pressure drop will depend on the length and the friction factor of each region within the higher pressure drop zone. Each region will have a characteristic dependency of the friction factor versus the Reynolds number. In addition, the heat transfer characteristic, as expressed as the Colburn J-factor, will also depend on the Reynolds number. At times, the desired heat transfer and pressure drop characteristics will require more than two regions within the higher pressure drop zone. This need for more regions would become more likely when the different extended surfaces within the higher pressure drop zone have substantial differences of the ratio of the friction factor to the Colburn J-factor as plotted against the Reynolds number. Under these conditions, heat transfer and pressure drop are not equally related for the different extended surfaces. Hence, more regions are required to obtain the preferred performance.

The present invention has been described with reference to preferred embodiments thereof. However, these embodiments should not be considered a limitation on the scope of the invention, which scope should be ascertained by the following claims.

We claim:

1. In a process for boiling flowing liquids in a heat exchanger wherein a flowing liquid is heated to vaporize said liquid, the improvement of which comprises:

(a) passing said flowing liquid through a first heat tranfer zone wherein said liquid is subjected to an overall high-convective heat transfer and an overall high pressure drop in a plurality of steps characterized in that each consecutive step in the direction of flow exposes the liquid to a lower pressure drop than the preceding step; and then (b) passing said flowing liquid through a second heat transfer zone to expose the liquid to an enhanced nucleate boiling heat transfer surface and a lower pressure drop than the overall pressure drop in the first heat transfer zone.

2. In a heat exchanger for boiling flowing liquids, the improvement of which comprises the incorporation of two sequential heat transfer zones of different characteristics in a single exchanger, wherein said heat exchanger comprises:

(a) a first heat transfer zone having means to create an overall high-convective-heat-transfer and an overall higher pressure drop, said means comprising a plurality of sub-zones arranged consecutively in the direction of flow of the boiling liquid wherein each of said consecutive sub-zones comprises in order a surface with a decreased pressure drop characteristic than the preceding sub-zone; and (b) a second essentially open channel heat transfer zone so constructed and arranged to provide an enhanced nucleate boiling heat transfer surface and a lower pressure drop characteristic.

3. The heat exchanger of claim 2 wherein said heat exchanger is a thermosyphon heat exchanger.

4. The heat exchanger of claim 2 wherein said heat exchanger is a shell and tube heat exchanger.

5. The heat exchanger of claim 2 wherein said heat exchanger is a plate-fin brazed heat exchanger.

6. The heat exchanger of claim 2 wherein said first heat transfer zone has a length in the range of 10 percent to 60 percent of the total length of said heat exchanger.

7. The heat exchanger of claim 2 wherein said first heat transfer zone has a length in the range of 20 percent to 40 percent of the total length of said heat exchanger.

8. The heat exchanger of claim 2 wherein said enhanced nucleate boiling heat transfer surface is a bonded high-porosity porous metal.

9. The heat exchanger of claim 2 wherein said enhanced nucleate boiling heat transfer surface is a mechanically formed surface.

10. The heat exchanger of claim 2 wherein said enhanced nucleate boiling heat transfer surface has a heat transfer coefficient greater than or equal to three times greater than for a corresponding flat plate.

11. The heat exchanger of claim 2 wherein the number of sub-zones in said first heat transfer zone is two.

12. The heat exchanger of claim 11 wherein the ratio of $(fL/D_H)_1/(fL/D_H)_2$, where L is the length of the sub-zone, $D_H$ is the hydraulic diameter, f is the friction factor, subscript 1 refers to the first sub-zone and subscript 2 refers to the second sub-zone of said first heat transfer zone, is greater than 5.

13. The heat exchanger of claim 11 wherein the ratio of $(fL/D_H)_1/(fL/D_H)_2$, where L is the length of the sub-zone, $D_H$ is the hydraulic diameter, f is the friction factor, subscript 1 refers to the first sub zone and subscript 2 refers to the second sub-zone of said first heat transfer zone, is greater than 10.

14. The heat exchanger of claim 11 wherein said heat exchanger is a plate-fin brazed heat exchanger and the surface of said first sub-zone is an easyway perforated fin, an easyway serrated fin, a hardway perforated fin or a hardway serrated fin.

15. The heat exchanger of claim 11 wherein said heat exchanger is a plate-fin brazed heat exchanger and the surface of said second sub-zone is a straight fin, an easyway perforated fin or an easyway serrated fin.

16. The heat exchanger of claim 11 wherein said heat exchanger is a plate-fin brazed heat exchanger and the surface of said first sub zone is a hardway perforated fin or a hardway serrated fin and the surface of said second sub-zone is a straight fin, an easyway perforated fin or an easyway serrated fin.

17. The heat exchanger of claim 11 wherein said heat exchanger is a shell and tube heat exchanger and the surface of said first sub-zone is a spiral fin, a series of perforated radial fins, a series of perforated disks mounted normal to flow or a series of baffles.

18. The heat exchanger of claim 11 wherein said heat exchanger is a shell and tube heat exchanger and the surface of said second sub-zone is a straight fin.

19. The heat exchanger of claim 11 wherein said heat exchanger is a shell and tube heat exchanger and the surface of said first sub-zone is a spiral fin, a series of perforated radial fins, a series of perforated disks mounted normal to flow or a series of baffles and the surface of said second sub-zone is a straight fin.

* * * * *